United States Patent [19]

Kaneko et al.

[11] 4,030,572

[45] June 21, 1977

[54] ELEVATOR CONTROL APPARATUS

[75] Inventors: Takashi Kaneko; Tatsuo Iwasaka; Takeo Yuminaka, all of Katsuta, Japan

[73] Assignee: Hitachi, Ltd., Japan

[22] Filed: Oct. 8, 1975

[21] Appl. No.: 620,761

[30] Foreign Application Priority Data

Oct. 11, 1974 Japan ..... 49-116102

[52] U.S. Cl. ..... 187/29 R

[51] Int. Cl.[2] ..... B66B 1/18

[58] Field of Search ..... 187/29

[56] References Cited

UNITED STATES PATENTS

| | | | |
|---|---|---|---|
| 3,967,702 | 7/1976 | Iwasaka et al. | 187/29 |
| 3,973,649 | 8/1976 | Iwasaka et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

In an elevator system comprising a plurality of elevator cars serving a plurality of floors in response to hall calls and cage calls, an elevator control apparatus is provided which comprises a device for forecasting cage calls as a new type of traffic information expected to be registered as hall waiting passengers take a given car. The device includes means arranged on each hall for detecting the number of prospective passengers waiting on the particular hall and means for setting the ratios of the hall waiting passengers destined for respective floors. The detected number of hall waiting passengers is multiplied by the ratios of destination floors (hereinafter referred to as "destination ratios") to figure out floors to which the hall waiting passengers joining the car are most likely to proceed, thus forecasting a corresponding cage call or calls. This cage call forecasting device is used in an elevator control system assigning hall calls, so that a cage call expected to be registered by the serving of a hall call is forecast at an early time. The waiting time required until each car reaches each floor, for example, is thus forecast with high accuracy taking into consideration cage calls expected to be registered in the future.

14 Claims, 18 Drawing Figures

FORECAST CAGE CALL CALCULATING CIRCUIT
CPU
CP
PT
SET
TO CARS BANDC
HP2D
HP2U
HP1U
G2DI
G2UI
G1UI
H2Da
H2Ua
H1Ua
ENC
F2Da
F2Ua
F1Ua
SIG1
SIG2
SIG3
SEL
FCCa
SHa
SCa
CAU
RSa
ADD1
REG
MOD
STO
TIM
k1
k2
ADD2
ISC1
2D
1OD
9U
2U
1U
R2D1
R1OD1
R9U1
R2U1
R1U1
W2Da
W1ODa
W9Ua
W2Ua
W1Ua

ELEVATOR CONTROL APPARATUS

The present invention relates to an elevator system or more in particular to an elevator control apparatus suitable for a plurality of group-controlled elevator cars in juxtaposition.

With the recent trend toward buildings rising higher and higher, elevator cars tend to be operated in a greater number in juxtaposition at a higher speed. Desirably, these elevator cars juxtaposed in a great number at a place should be controlled in effective relation to each other to improve the operating efficiency of the group of cars as a whole. There is a method which employs a group control system whereby hall calls are assigned to cars thereby to control them in relation to each other. A method recently developed for assigning hall calls to cars is to determine a forecast waiting time required for each car to reach a floor generating a hall call and then by assigning the hall call to a car involving the shortest forecast waiting time. The forecast waiting time is determined for each car on the basis of the distance from each car position to the hall call-generating floor and the number of floors to be served by each car before reaching the hall-call generating floor.

In conventional elevator control apparatuses, cage calls used for control purposes are only those already registered with the car involved. The number of floors to be served on the basis of which the forecast waiting time is determined as above is obtained from the number of cage calls already registered with the car and, in the case of a control system assigning hall calls to cars, the number of hall calls which have been assigned to the car. When the car serves a hall call and the waiting passengers at the hall-call-generating floor take the car, however, a cage call or cage calls are newly registered with the car. As a result, the number of floors of, say, 2 to be served which is previously determined in response to already-registered cage calls before reaching a given floor is actually increased to, say, 3 or 4, thus leading to a great error in the already-determined forecast waiting time. This increase in the number of cage calls to be served by the additional passengers taking the car occurs almost inevitably in the course of travel of every car, and always undermines the stability of the forecast waiting time, posing one of the great blocks to an improved elevator control efficiency. Naturally, an indication, if any, of the forecast waiting time on the elevator hall involved is deteriorated in accuracy, thus substantially adversely affecting the advantage of the indication system.

For similar reasons, it is impossible to properly control the distance between running cars by the use of the number of floors to be served by each car. In other words, in the elevator control system using the number of floors to be served by each car and the identity of the particular floors, a change which may occur in the number of cage calls by the additional passengers taking the car and the resulting change in the number of floors to be served and the identity of the such floors constitute a direct cause of the requirement for an additional control process, thus hampering satisfactory control operation.

An object of the present invention is to provide a novel device for forecasting a cage call or calls expected to be registered as an additional type of traffic information by hall waiting passengers taking each car in order to enable a highly reliable elevator control.

Another object of the invention is to provide an elevator control apparatus with high operating efficiency taking advantage of cage calls expected to be registered in future, thus contributing to an improved elevator service.

According to one aspect of the invention, the ratio of each destination of hall waiting passengers on a given floor is determined in advance, and a cage call is forecast by figuring out a destination or destinations to which the hall waiting passengers on the particular floor are most likely to proceed to, on the basis of the number of the hall waiting passengers and the destination ratios.

According to another aspect of the invention, in an elevator control apparatus assigning hall calls to cars, a cage call or calls expected to be registered with each car are forecast, and the waiting time required until each car reaches each floor is calculated with high accuracy taking into consideration the forecast cage call or calls thereby to assure proper assignment of hall calls and other control operation by the use of the determined forecast waiting time.

The above and other objects, features and advantages will be made apparent by the detailed description taken in conjunction with the accompanying drawings, in which:

FIGS. 9 to 17 show applications of the invention to the hall call assignment type of elevator control system: in which FIG. 9 shows circuits for generating a reset signal and a select signal used in the circuit of FIG. 11 for a car A;

FIG. 10 shows a waveform of clock pulses;

FIG. 11 is a diagram showing a forecast-cage-call-and-forecast-waiting-time-calculating circuit for car A;

FIG. 12 shows an example of the output waveform from the signal generator of FIG. 11;

FIG. 13 shows another example of the output waveform from the signal generator of FIG. 11;

FIG. 14 is a diagram of the hall-call-assigning circuit involving a 2nd-floor up hall call;

FIG. 15 is a diagram of the forecast-waiting-time-indication circuit for car A arranged on the 2nd-floor for up travel;

FIG. 16 is a diagram of the second-forecast-cage-call-calculating circuit for car A;

FIG. 17 shows a lockout circuit for 2nd-floor up travel; and

Figure 1:
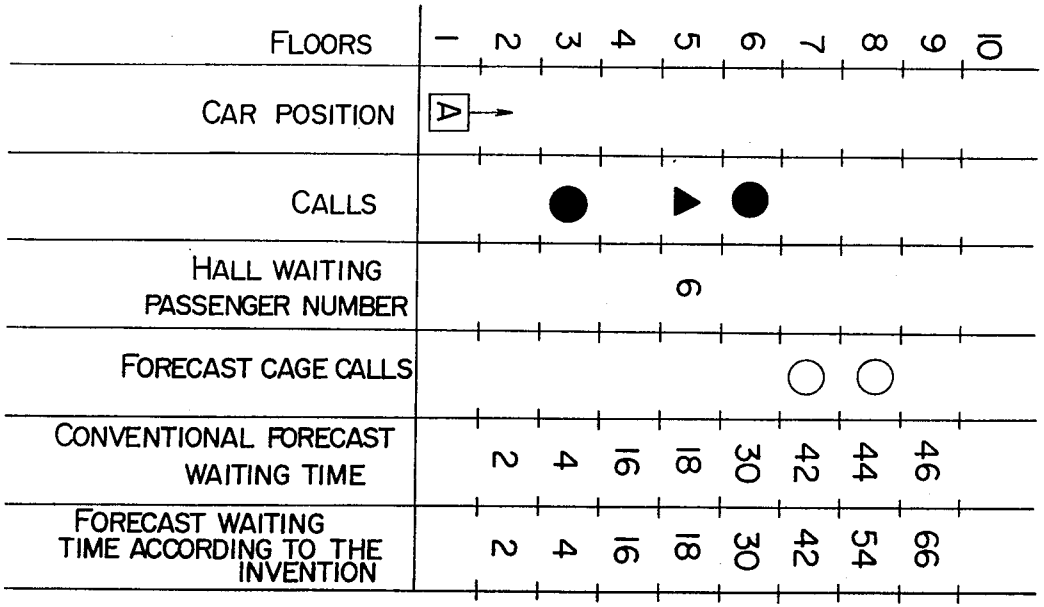
FIG. 1 is a diagram for briefly explaining the operation of the invention.

Prior to entering the explanation of specific embodiments of the invention, an outline of the invention will be described with reference to the operation diagram of FIG. 1. In this drawing, car A provided for serving the first to 10th floors is now positioned at the first floor for up travel. Assume that car A has 3rd- and 6th-floor cage calls registered therewith as indicated by marks and at the same time is assigned with a 5th-floor up hall call as indicated by mark . Under this condition, this invention is such that 6 hall waiting prospective passengers, for example, are detected for up travel from the 5th floor, so that a floor or floors to which they are most likely to proceed to are forecast on the basis of a predetermined destination ratio for each floor. Assume for example that the hall waiting passengers joining the car A at the 5th floor for up travel cause 7th- and 8th-floor cage calls to be generated in and registered with car A. The forecast cage calls are used as an element for calculation of the forecast waiting time required until the car reaches each floor. Suppose it takes 2 seconds for the car to cover one-floor interval and 10 seconds to stay at one floor for service. According to the conventional control systems, the floors to be served are determined to be the 3rd, 5th and 6th floors and the forecast waiting time required for the car to reach, say, the 9th floor is calculated at 46 seconds. By the method of the invention, by contrast, the forecast waiting time until the 9th floor is reached is determined to be 66 seconds in view of the generation of 7th- and 8th-floor cage calls forecast as a result of serving the 5th-floor hall call.

In fact, a new cage call or calls are generated whenever a hall call is served. Therefore, the forecasting of cage calls as in the invention provides very effective means for accurate elevator control. Generally, elevator car passengers do not behave quite randomly but according to a certain pattern capable of being predetermined on the basis of such factors as the character of the building, the composition of prospective passengers and traffic demand. Therefore, by determining the number of prospective passengers waiting on each hall, a cage call or calls which may be produced by their joining a car are capable of being forecast with comparatively high accuracy. When taking into account of the traffic demand and other factors capable of being forecast, a higher accuracy of cage call forecasting is possible.

In the description herein, by the way, forecast cage calls generated by hall waiting passengers include in the meaning thereof destination floors of the hall waiting passengers.

Figure 2:
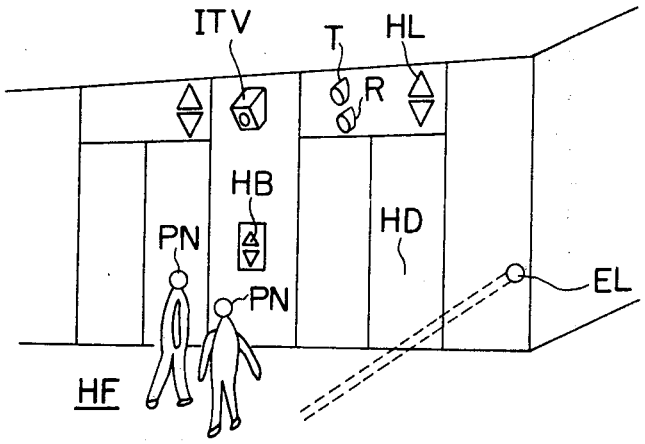
FIG. 2 is a diagram schematically showing an elevator hall.

An outline of an elevator hall is shown in FIG. 2. HL shows a hall lantern for indicating the arrival of a car, HB a hall call button for calling a car, and HD an elevator door. To detect the number of the hall waiting passengers PN on the hall, methods as mentioned below have so far been suggested.

1. Mat switch:

A mat switch divided into a multiplicity of units each having an area as large as 60 cm by 40 cm for accommodation of one perspective passenger is arranged on the elevator hall floor, so that the number of waiting passengers is detected by detecting the number of mat switch units energized.

2. Industrial television camera:

An industrial television camera ITV is arranged directed toward the hall waiting passengers PN, and by processing an image picked up by the camera, the number of hall waiting passengers is determined.

3. Photo-electric device:

A photo-electric device or devices EL are located at the entrance and exit of the elevator hall floor HF to detect the number of the hall waiting passengers by counting persons who have passed the photo-electric device EL.

4. Supersonic wave transmitter T and receiver R:

A wave transmitter T for transmitting supersonic wave toward the hall waiting passengers PN and a wave receiver R for receiving supersonic wave reflected from them are used, the hall-waiting passenger number being detected by processing a signal received from the receiver R.

Of all these devices, the function of the supersonic wave devices T and R of (4) above will be explained below briefly with reference to FIGS. 3 and 4.

Figure 3:
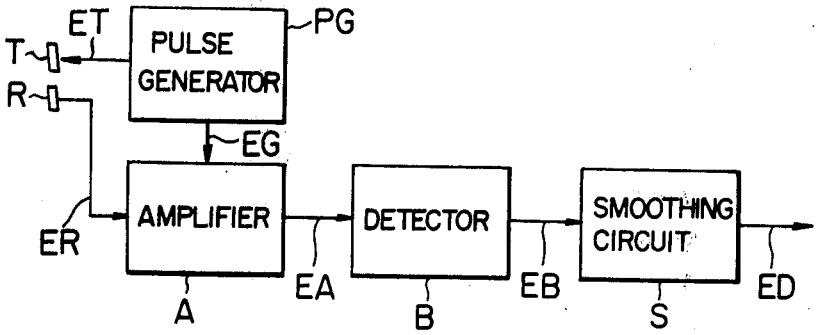
FIG. 3 is a block diagram showing a hall-waiting-passenger-number detector according to an embodiment of the invention.
Figure 4:
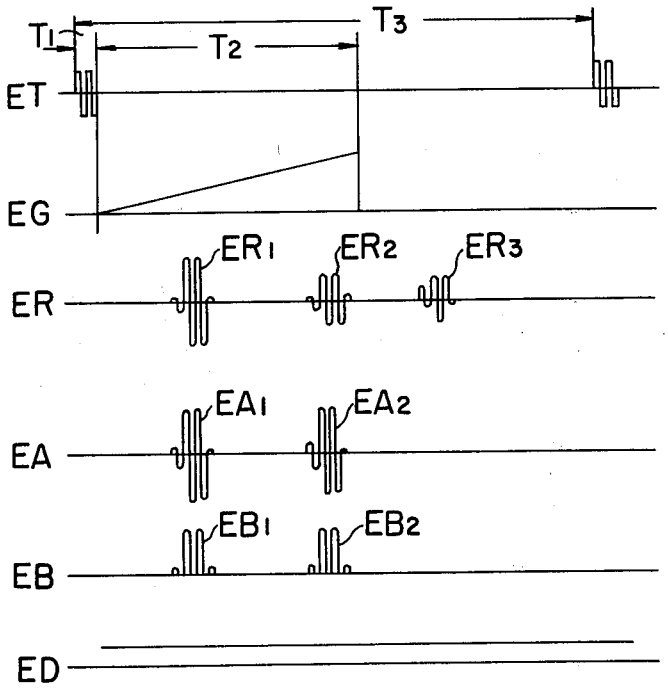
FIG. 4 shows waveforms produced from various parts of the apparatus of the invention for explaining the operation of the device shown in FIG. 3.

A block diagram of the hall-waiting-passenger-number detector according to an embodiment of the invention is shown in FIG. 3 and signal waveforms for explaining the operation of the device of FIG. 3 are illustrated in FIG. 4.

As shown in FIG. 4, the pulse generator PG generates a transmission signal ET and a gain signal EG, while the transmitter T sends out supersonic wave only during the generation of the transmission signal ET. The transmission signal ET comprises portions of alternating current wave each continuing for a period of $T_1$ or about 0.2 ms in the frequency range of, say, 25 KHz and appearing at the repetition frequency of $T_3$. The gain signal EG is a triangular signal starting upon completion of the transmission signal EG and rising in a straight line during the period $T_2$, while remaining zero during the period from the end of $T_2$ to the end of $T_3$.

The received signal ER which is the output voltage of the receiver R contains a wave portion $ER_1$ reflected from a nearby person, a wave portion $ER_2$ reflected from a remote person and an unnecessary wave portion $ER_3$ reflected from a farther wall or the like. $ER_2$ is smaller than $ER_1$ in amplitude. The received signal ER is transformed and amplified into an output signal EA by a variable gain amplifier A the gain of which is proportional to the gain signal EG. In other words, the relation $EA \alpha EG \cdot ER$ is established, and therefore the amplifier A may be considered as an analog multiplier for making a product of the signals EG and EA.

The amplifier A and the gain signal EG function in such a manner that the amplifier output EA is maintained substantially at signals $EA_1$ and $EA_2$ corresponding to the signals $ER_1$ and $ER_2$ respectively. The time required for receiving the reflected wave $ER_3$ from a far wall is longer than $T_2$, and therefore no signal corresponding to $ER_3$ is produced as an output EA of the amplifier, thus eliminating undesired signals arriving from outside of the effective scope of detection.

Only positive portions of the amplifier output EA are picked up by the detector B. The output EB of the detector B is applied through the smoothing circuit S and takes the form of a signal ED proportional to the number of hall waiting passengers. The time constant of the smoothing circuit S is so large as compared with the repetition frequency $T_3$ of the transmitted pulses that the signal ED is a DC voltage equal to the average value of the detection output EB. On the other hand, the signal ER received from the hall waiting passengers PN is shaped into the same waveform and smoothed regardless of the positions of the waiting passengers PN, and therefore the signal ED has a value proportional to the hall waiting passenger number.

In this way, the number of the hall waiting prospective passengers may be detected.

More detailed explanation will be made below with reference to an embodiment of the invention.

Figure 5:
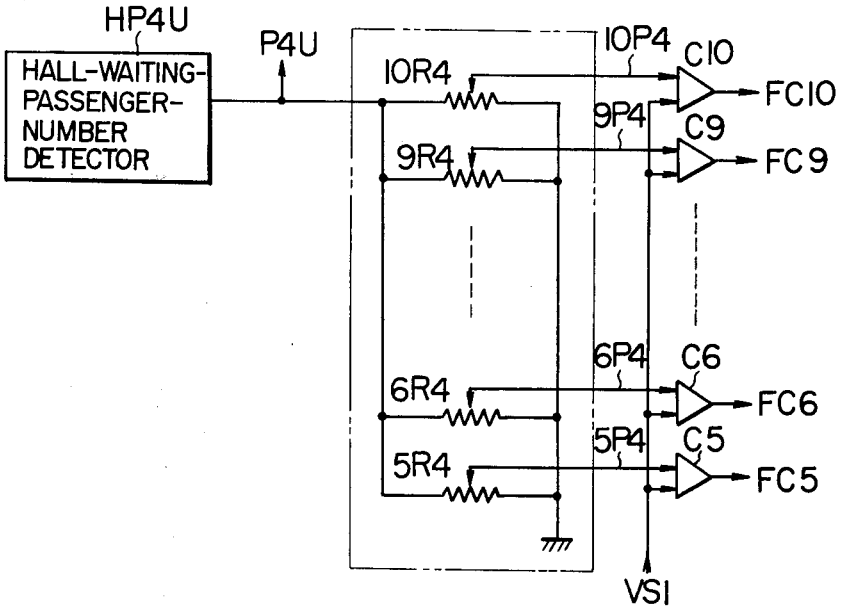
FIG. 5 is a diagram showing a configuration of the cage-call-forecasting-and-calculating circuit according to an embodiment of the invention, the circuit being a case for up travel from the 4-th floor.

The diagram of FIG. 5 illustrates a cage call foregoing circuit according to an embodiment of the invention. To facilitate the understanding, the fundamental configuration of the circuit is shown in its simplest form, taking up a circuit for up travel from the 4th-floor as an example.

In the drawing under construction, HP4U shows the hall-waiting-passenger-number detector already described, which produces a signal representing the hall waiting passenger number P4U for up travel from the 4th-floor. 5R4 to 10R4 show variable resistors for setting the destination ratio of the up-traveling 4th-floor prospective passengers for each of the destination floors including the 5th to 10th floors. The output of the hall-waiting-passenger-number detector HP4U is applied to the variable resistors 5R4 to 10R4, where it is divided in voltage according to a predetermined ratio thereby to take the forms of the passenger-number-by-destination signals 5P4 to 10P4.

Assume that the ratios set in the variable resistors 5R4 to 10R4 are 0.2, 0.0, 0.0, 0.2, 0.2 and 4.0 respectively, the total thereof being 1. If 5 persons are detected by the waiting-passenger-number detector HP4U, the numbers of hall waiting passengers 5P4 to 10P4 traveling from the 4th floor upward to the 5th floor to 10th floor respectively are $5 \times 0.2 = 1$, $5 \times 0.0 = 0$, $5 \times 0.0 = 0$, $5 \times 0.2 = 1$, $5 \times 0.2 = 1$ and $5 \times 0.4 = 2$ respectively. In other words, it is detected that, of the 5 persons traveling up from the 4th floor, 1 person may be destined for each of the 5th, 8th, and 9th floors, and 2 persons for the 10th floor.

The passenger-number-by-destination signals 5P4 to 10P4 thus detected are applied to the comparators C5 to C10 respectively, where they are compared with the reference voltage VS1 representing, say, 1 or 0.8 persons in the number of passengers by destination. The comparators C5 to C10 produce outputs FC5 to FC10 respectively when the waiting-passenger-number-by-destination signals 5P4 to 10P4 are larger than the reference voltage VS1 respectively. In other words, a cage calls is forecast on condition that a passenger number by destination is larger than the reference value. The signals FC5 to FC10 thus represent forecast cage calls. In the case under consideration, cage calls for the 5th, 8th, 9th and 10th floors are forecast in response to the detection of 5 hall waiting passengers for up travel from the 4th floor.

After detecting each number of passengers by destination represented by signals 5P4 to 10P4 as mentioned above, the cage calls FC5 to FC10 are forecast. In this connection, the destination ratios set in the variable resistors 5R4 to 10R4 play a very important role in determining the accuracy of detection of each passenger number by destination and hence the accuracy of forecasting cage calls. In an ordinary building, the demand for elevator service as well as destinations varies from one floor to another, so that, if the accuracy of cage call forecasting is to be improved, it is important to determine the destination ratios in accordance with the character and other nature of each floor. For a specific floor or lobby floor frequented by passengers, for instance, the destination ratio should be set at a high value, while it may be determined low for the floor where a storage or like is located. Another factor to be taken into consideration in distributing the ratios may be the history of the passengers. Further, the service demand for cars is subjected to variations with time of a day; Most people are destined for the lobby floor during evening rush hours while during the lunch recess the greater part of the lunch recess the greater part of the passengers proceed to the floor where a cafeteria or restaurant is located. (U.S. Pat. No. 3,642,099 discloses an apparatus for detecting the changes in traffic demand with time of a day classified into morning rush hours, evening rush hours, lunch recess and other times.) It is therefore effective to readjust the above-determined destination ratios according to the traffic demand changes in a day. It may also be recommendable to readjust the destination ratios taking into account the number of prospective passengers waiting at each floor.

Figure 6:
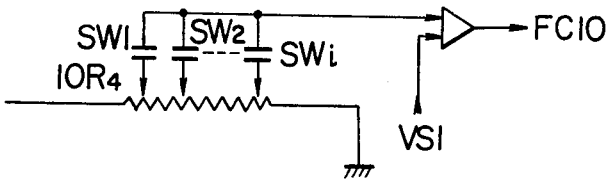
FIG. 6 shows a construction of means for adjusting the destination ratio obtained from the circuit of FIG. 5 according to an embodiment of the invention, the means showing a case for up travel to the 10th-floor.

Another embodiment in which the destination ratios are adjusted by the use of switchable variable resistors is shown in FIG. 6. This drawing shows the case of setting the ratio of prospective passengers at the 4th floor who want to proceed to the 10th floor. Appropriate ratios are set in advance in a multiplicity of switches SWi juxtaposed, which are shifted arbitrarily either automatically or manually in response to signals representing a traffic demand detected by the apparatus as disclosed in U.S. Pat. No. 3,642,099, or in response to the operation of a time switch by the elevator caretaker.

Figure 7:
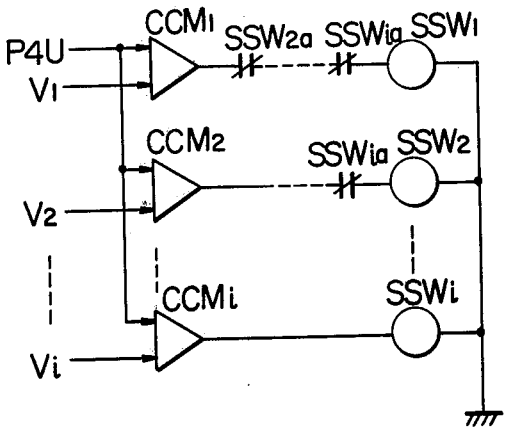
FIG. 7 shows a circuit construction of the hall waiting passenger number decision circuit for adjusting the destination ratios according to an embodiment of the invention, the circuit showing a case for up travel from the 4th-floor.
Figure 18:
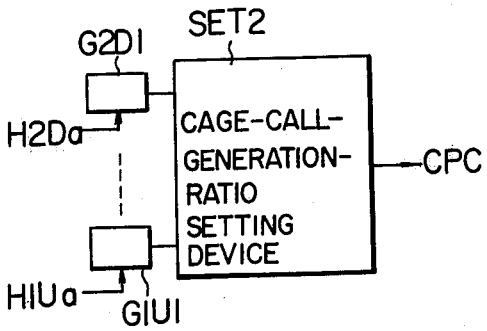
FIG. 18 is a block diagram showing a cage-call-generation-ratio-setting device according to an embodiment of the invention.

When the number of prospective passengers is taken into account, on the other hand, the output signal P4U of the waiting-passenger-number detector HP4U is compared with the reference voltage Vi representing a predetermined number of persons, by the comparator CCMi as shown in FIG. 7. Depending on the positive or negative state of the output of the comparator CCMi, the relay SSWi connected to the comparator CCMi is actuated, so that the contacts of the switches SWi in FIG. 6 are shifted thereby to readjust the destination ratios.

In this way, the destination ratios are readjusted on the basis of changes in traffic demand and the number of waiting passengers at each floor, thus always making possible highly accurate forecasting of cage calls.

According to the present invention, there is provided, as mentioned above, an apparatus capable of forecasting cage calls as a new type of traffic information derived from hall waiting prospective passengers. The cage calls thus forecast are utilized for elevator control operation, thereby permitting a highly reliable elevator control taking into consideration cage calls expected to be generated in the future, resulting in an improved elevator car service.

Figure 8:
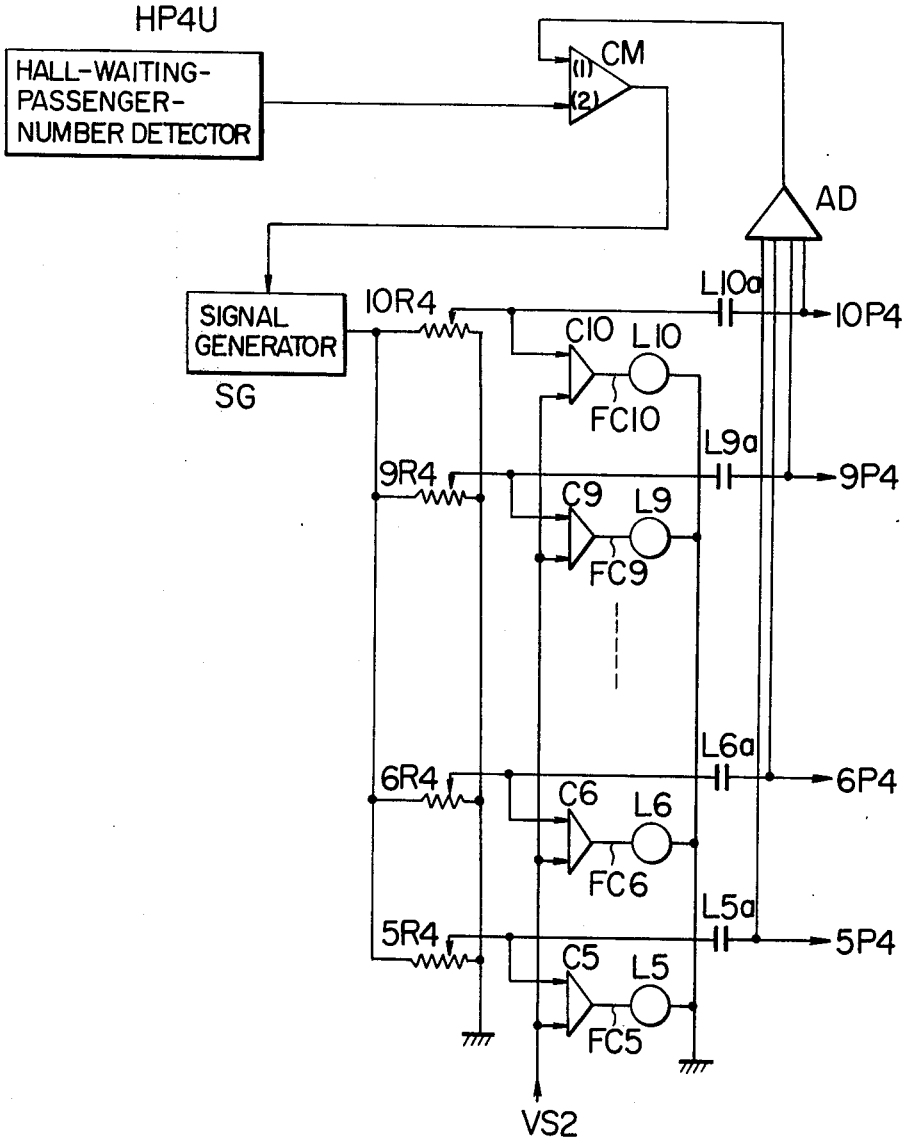
FIG. 8 is a diagram showing a configuration of the cage-call-forecasting-and-calculating circuit according to another embodiment of the invention, the circuit involving a case for up travel from the 4th-floor.

The diagram of FIG. 8 shows the cage call forecasting circuit according to another embodiment of the invention. This embodiment employs the fundamental construction of the embodiment of FIG. 5 and is capable of improving the accuracy of the detected waiting-passenger-number-by-destination and even the forecast cage calls.

Handling the case of up travel from the 4th floor as in the embodiment of FIG. 5, the embodiment under consideration shown in FIG. 8 has like component elements denoted by like reference characters or numerals in FIG. 5. Reference character CM shows a comparator which produces a positive or a negative signal in accordance with whether the input voltage applied to the input terminal (2) is higher or lower than that applied to the input terminal (1) respectively. When the signals applied to the terminals (1) and (2) are equal to each other, the output of the comparator CM is in the state of "0". SG shows a voltage signal generator which so functions that; the output voltage therefrom is increased when the output signal from the comparator CM is positive; the output therefrom is maintained at "0" when the output signal from the comparator CM is "0"; and the output thereof is decreased when the output voltage from the comparator CM is negative. L5 to L10 show relays energized in response to the generation of the outputs FC5 to FC10 of the comparators C5 to C10 respectively, thus energizing the contacts L5*a* to L10*a* respectively. Reference character AD shows an adder for adding the signals 5P4 to 10P4 to each other.

The output of the hall-waiting-passenger-number detector HP4U is applied through the comparator CM to the voltage signal generator SG, which in turn generates a voltage corresponding to the hall waiting passenger number and applies it to variable resistors 5R4 to 10R4 assigned with the ratios for distribution of hall waiting passengers among the floors ahead, as already explained. The passenger-number-by-destination signals 5P4 to 10P4 are thus produced in accordance with the set destination ratios and applied to the comparators C5 to C10 for comparison with the reference voltage VS1. Of the output signals FC5 to FC10 of the comparators C5 to C10, only those outputs involving a waiting-passenger-number-by-destination signal higher than the reference voltage VS1 are produced thereby to energize the corresponding ones of the relays L5 to L10, thus turning on the corresponding ones of the contacts L5*a* to L10*a*. In other words, the operation of the relays L5 to L10 represents forecast cage calls, so that only the waiting-passenger-number-by-destination signals higher than the reference voltage VS1 are produced through the corresponding ones of the contacts L5*a* to L10*a*. The selected ones of the waiting-passenger-number-by-destination signals 5P4 to 10P4 are added to each other in the adder AD, the output of which is compared with the output of the hall-waiting-passenger-number detector HP4U by the comparator CM. The comparator CM thus compares the total of the waiting passenger numbers by destination with the hall waiting passenger number and produces an output which is used to increase or decrease, as the case may be, the output signal of the voltage signal generator SG, thus rendering the total waiting passenger number by destination equal to the hall waiting passenger number.

By way of more specific explanation, suppose the variable resistors 5R4 to 10R4 are set at the destination ratios of 0.4, 0.2, 0.1, 0.05, 0.2 and 0.05 respectively, and that the reference voltage is set at a voltage level corresponding to 0.8 persons. Under this condition, also assume that the hall waiting passenger number detector HP4U produces an output signal representing 5 persons. If the output of the voltage signal generator SG is increased up to a level representing 5 perons, then the outputs of the variable resistors 5R4 to 10R4 take the form of voltages corresponding to $5 \times 0.4 = 2$ persons, $5 \times 0.2 = 1$ person, $5 \times 0.1 = 0.5$ persons, $5 \times 0.05 = 0.25$ persons, $5 \times 0.2 = 1$ person, and $5 \times 0.05 = 0.25$ persons, respectively. These outputs are compared with the reference voltage VS1 in the comparators C5 to C10 respectively, with the result that only the comparators C5, C6 and C9 impressed with the outputs of the variable resistors 5R4, 6R4 and 9R4 which are higher than the reference voltage VS1 produce the ouputs FC5, FC6 and FC9 respectively. Only the relays L5, L6 and L9 are energized thereby to turn on their contacts L5*a*, L6a and L9a respectively, so that the waiting-passenger-number-by-destination signals 5P4 to 10P4 are produced as voltage signals corresponding to 2, 1, 0, 0, 1 and 0 person respectively. These values are added to each other by the adder AD, which in turn produces a voltage signal representing 4 persons. The comparator CM, the terminal (2) of which is impressed with a higher voltage than the terminal (1), produces a positive signal, thus further increasing the output voltage of the voltage signal generator SG. Assume here that the output voltage of the voltage signal generator SG has been increased up to a level representing 6.25 persons. As in the preceding case, the outputs of the variable resistors 5R4 to 10R4 take the form of voltages corresponding to 2.5, 1.25, 0.625, 0.3125, 1.25, 0.3125 persons respectively, so that the relays L5, L6 and L9 are turned on thereby to maintain their contacts L5*a*, L6*a* and L9*a* in the energized state. The signals 5P4 to 10P4 representing the number of waiting passengers for each of the destination floors become voltages corresponding to 2.5, 1.25, 0, 0, 1.25 and 0 person respectively. The adder Ad produces an output representing 5 persons, the comparator CM produces a "0" output, and the voltage signal generator SG keeps its output.

It will be noted from the above that cage calls are forecast by the operation of the relays L5 to L10. The waiting-passenger-number-by-destination signals 5P4 to 10P4 are always distributed among the floors for which cage calls are forecast, so that each of the passenger-number-by-destination signals is corrected in such a manner that the total sum of the waiting-passenger-number-by-destination signals coincides with the hall waiting passenger number. In this way, a reasonable relation between the forecast cage calls and each passenger number by destination is established, thus preventing any error between the total passenger number by destination floor and the number of hall waiting passenger number.

In the above-described embodiments, the fundamental construction of the invention is explained with reference to analog circuits to facilitate the understanding. Also, the forecast cage calls are determined on the basis of each passenger number by destination. The scope of the present invention, however, is not limited to such embodiments.

The invention will be explained below with reference to still another embodiment. The embodiment shown below is concerned with a case in which each of the component circuits is constructed digitally and applied to a control system assigning hall calls to a car or cars. Also, the forecasting of cage calls is effected for each car assigned with hall calls. In other words, cage calls which may be generated at the time of hall waiting passengers joining a given car in the future are forecast for each car. The description below also refers to an example of elevator control taking into account the forecast cage calls thus determined. By the way, the embodiment below involves a case in which three elevator cars A, B and C cover the 1st to 10th floors.

Figure 9:
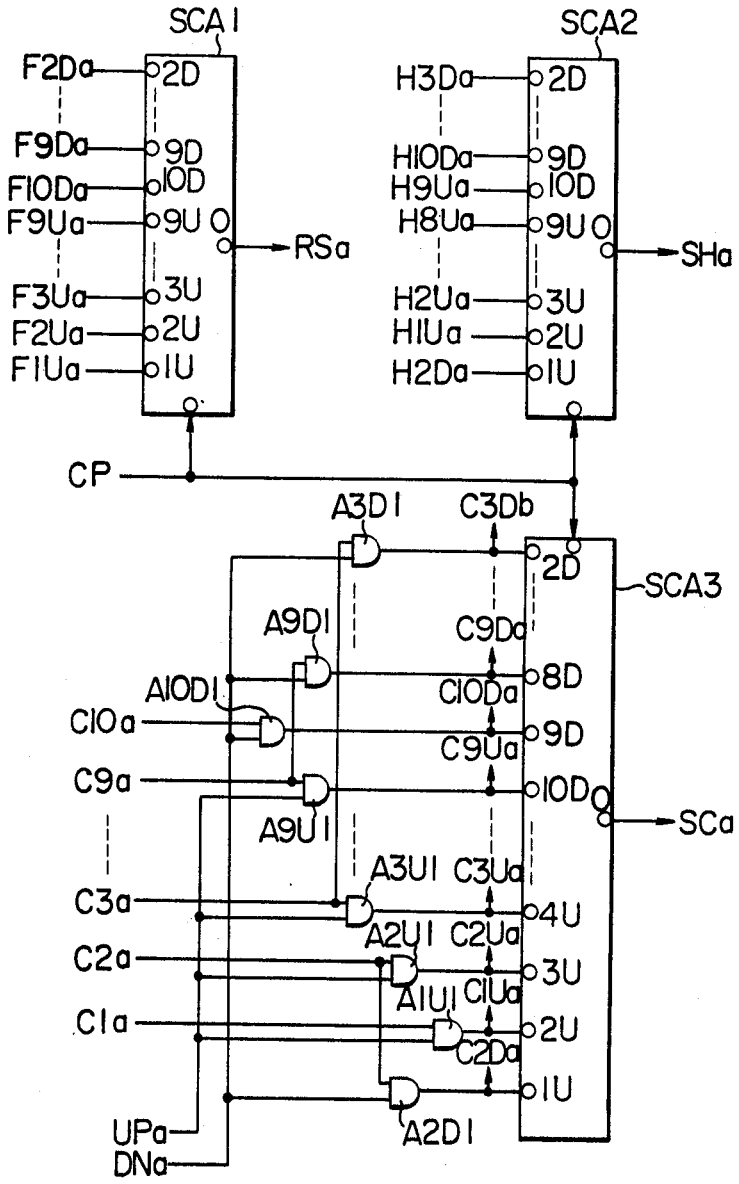
Figures 10, 11:
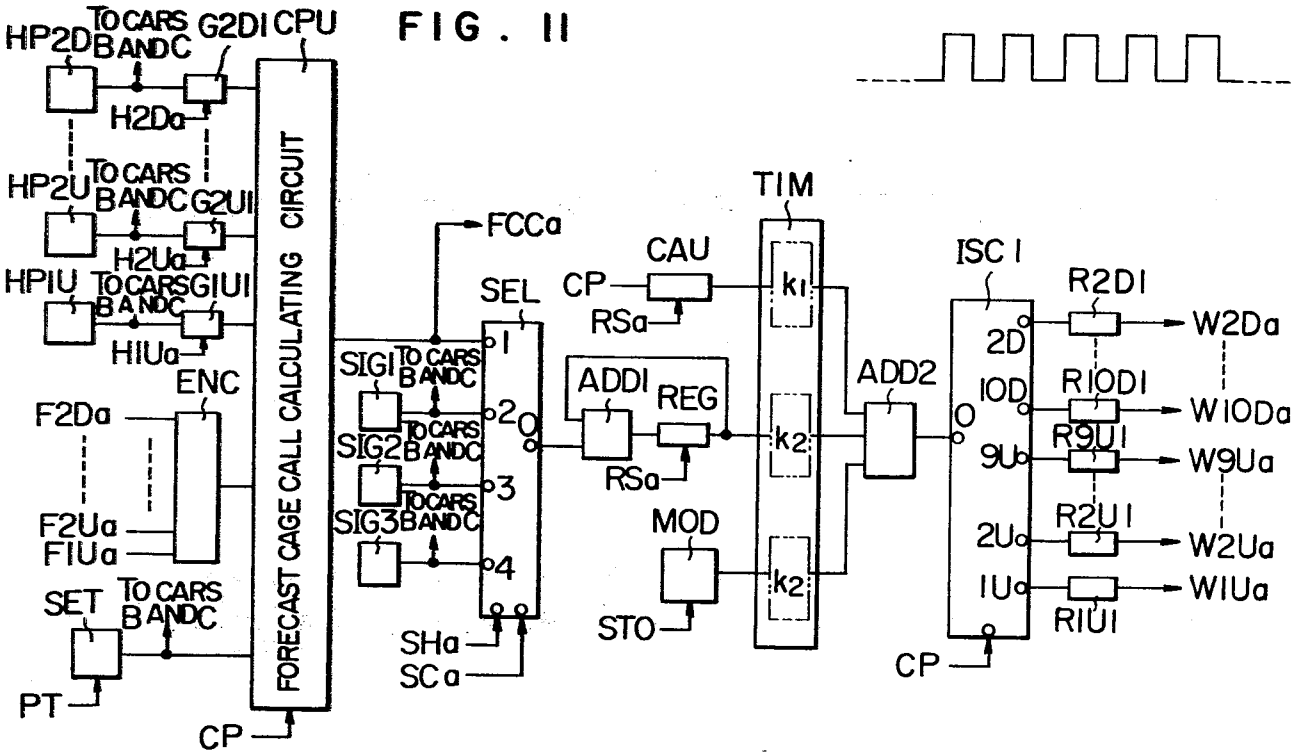

The diagram of FIG. 9 shows a circuit for producing reset signals for the counter and the register and a select signal for the selector in FIG. 11 for car A, a similar circuit being provided for each of the cars B and C.

F1U*a*, F2U*a*, . . . . , F9Ua, F10Da, . . . . , F2D*a* show elevator car position signals which become "1" when the leading floor positions of car A are the 1st floor for up travel, the 2nd floor for up travel, . . . , the 9th floor for up travel, the 10th floor for down travel, . . . , the 2nd floor for down travel respectively, while they shift to "O" in the remaining cases. (A leading floor position means the nearest floor serviceable by a car, which is generally several floors ahead of the actual position of the car depending on the speed at which it is running. For example, it is 3 floors ahead when the car is running at 150 m/minute and will be called hereinafter merely as "elevator car position".) H1U*a*, H2U*a*, . . . , H2D*a* show hall call assignment signals which are introduced from the circuit of FIG. 14 and change to "1" state when car A is assigned with the 1st-floor up hall call, the second-floor up hall call, . . . , the second-floor down hall call respectively.

C1*a*, C2*a*, . . . , C10*a* show cage call signals which turn to "1" when the 1st-floor, 2nd-floor, . . . , 10th -floor cage calls are registered respectively with a register mounted in car A. The signals UPa and DNa are indicative of the directions of travel of car A. The cage call signals C1*a* to C9*a*, together with the up-travel signal UP*a*, are applied to the AND elements, A1U1, A2U1, . . . , A9U1 respectively; whereas the cage call signals C2*a*, C3*a*, . . . , C9*a* together with the down travel signal DN*a*, are applied to the AND elements A2D1, A3D1, . . . , A10D1. As a result, the cage call signals C1*a* to C9*a* are transmitted to the output of the AND elements A2U1 to A9U1 when the up-travel signal UP*a* is "1"; whereas the cage call signals C2*a* to C10*a* reach the output terminals of the AND elements A2D1 to A10D1 when the down-travel signal DN*a* is in the state of "1". Assume for example that the signal UP*a* is "1" and signal DNa "0" when car A is running up and that the second floor cage call is registered with the signal C2*a* changing to "1". The AND element A2U1 produces a "1" signal since both of the inputs thereto are "1". On the contrary, the AND element A2D1 produces a "0" signal as an input thereto is in the state of "0". In the description hereinafter unless otherwise specified, the outputs of the AND elements, A1U1, A2U1, . . . , A2D1 taking into consideration the direction of car travel will be called merely as cage calls in place of the signals C1*a* to C10*a;* while the signals C1U*a*, C2U*a*, . . . , C2D*a* will be referred to as cage calls for the 1st-floor up travel, the second-floor up travel, . . . , second-floor down travel respectively.

Scanners SCA1 to SCA3 are for producing at their output terminals 0 the signals applied to the input terminals 1U, 2U, . . . , 9U, 10D, . . . , 2D in that order followed by the terminal 1U, tnus endlessly in response to the clock signals CP of FIG. 10 with predetermined intervals. In this connection, it is assumed that when the signal applied to the input terminal 1U is produced at the output terminal 0 of the scanner SCA1, the signal applied to the input terminals 1U is also produced at the output terminals of the scanners SCA2 and SCA3 respectively, thus causing the scanners SCA1 to SCA3 to fall in synchronism. By the way, when the signals applied to the input terminals 1U, 2U, . . . , 2D are produced at the output terminal 0, the floors scanned by the clock pulses CP are considered hereinafter to be the 1st floor up, second floor up, . . . , second floor down respectively.

The scanner SCA1 thus produces position signals F1U*a*, F2U*a*, . . . , F2D*a* as the respective floors are scanned by the clock pulses CP, which signals take the form of reset signals RS*a* for the counter and register in FIG. 11. Take note of the fact that the input terminal 1U of the scanners SCA2 and SCA3 is connected to the 2nd-floor down hall call signal H2D*a* and cage call signal C2D*a;* the input terminal 2U to the 1st-floor up hall call signal H1Ua and cage call signal C1U*a;* and the input terminal 2D to the 3rd floor down hall call signal H3D*a* and cage call signal C3D*a*. As the clock pulses are applied to the scanner SCA2, the scanner SCA2 produces the hall call signals H1U*a*, H2U*a*, . . . , H2D*a* and cage call signals C1U*a*, C2U*a*, . . . , C2D*a* covering the scanned floors, which signals are applied to the selector as select signals Sh*a* and SC*a*. Suppose car A is positioned at the second floor for up travel, and therefore the signal F2U*a* is "1" and that the signals H2U*a* and C2U*a* are "1" as the second-floor up hall call and cage call are registered. When the floors scanned by the clock pulses CP are the second floor for up travel, the signal RS*a* is "1" and the signals SH*a* and SC*a* "0;" while when the floor scanned is the 3rd floor for up travel, the signal RSa is "0" and the signals SH*a* and SC*a* are in the state of "1". In cases of the other floors being scanned, the signals RS*a*, SH*a* and SC*a* are all "0".

An embodiment making up a feature of the invention is shown in FIG. 11. This embodiment comprises a circuit for determining forecast cage calls namely, cage calls which may be generated by waiting passengers when they are served car A in response to a hall call, and a circuit for calculating a forecast waiting time which will be required for car A to reach each floor while serving intermediate floors in response to any calls which may be generated before reaching the ball-call-generating floor.

CAU is a counter which counts the clock pulses CP as they are applied thereto. While producing the result of counting operation, the counter CAU is reset to zero when the reset signal RSa is in the state of "1", that is, when the floor scanned by the clock pulses CP coincides with the position of car A. The output of the counter CAU thus represents the interval $Fj = j - k$ between the position $k$ of car A and the floor scanned by the clock pulses CP. In the event that the floor scanned by the clock pulses CP is the 2nd floor up while car A stays at the 3rd floor for down travel, then the counter CAU produces a signal representing an interval of 3 floors.

It was already mentioned that the waiting-passenger-number detectors HP1U, HP2U, . . . , HP2D are for detecting and producing output signals representing the number of hall waiting passengers at the 1st floor for up travel, the 2nd floor for up travel and the 2nd floor for down travel. A waiting-passenger-number detector is not required for each car but only for each floor and transmits an output therefrom to the cage call forecasting circuits for cars B and C also. The outputs from the waiting-passenger-number detectors HP1U, HP2U, . . . , HP2D are applied to the gate element G1U1, G2U1, . . . , G2D1 respectively; while they are applied to the forecast cage call calculating device CPU only when the hall call signals or gating signals H1U*a*, H2U*a*, . . . , H2D*a* are in the state of "1" respectively, namely, when a hall call for the floor involved is assigned to car A.

ENC shows an encoder which produces signals proportional to the positions of car A in response to the position signals F1U*a*, F2U*a*, . . . , F2D*a* of car A, an output of which is applied to the forecast cage call calculating device CPU.

SET shows a destination-ratio setting device for determining the ratios of destinations of hall waiting passengers, indicating how may percents of the hall waiting passengers joining the car at a floor assigned to a car are proceeding to which floors. This device has a similar function to the variable resistors 5R4 to 10R4 in the aforementioned embodiment. The destination ratios determined by the destination-ratio setting device SET may be readjusted by, say, the output signals PT representing such traffic patterns as morning rush hours, evening rush hours, lunch recess and the other times of day as disclosed by U.S. Pat. Ser. No. 3,642,099.

An example of the destination ratios of the wating passengers set in the destination-ratio setting device SET is shown in Table 1. This table shows that passengers joining the car at the 6th floor for up travel are likely to proceed to the 7th floor up, the 8th and 9th floors up, the 10th floor down and the other floors in the ratio of 0.4 : 0.2 : 0.2 : 0.0 respectively. The output of the destination-ratio setting device SET is also applied to the forecast cage call calculating device CPU together with the outputs from the waiting-passenger-number detectors HP1U to HP9U, HP10D to HP2D and the encoder ENC.

The forecast cage call calculating device CUP is for proceeding and producing forecast cage calls, namely, cage calls which may be produced by car A serving an assigned hall call and the waiting passengers joining the car from the floor involved. Let the destination ratio of passengers riding from the *i*-th floor to the *j*-th floor be rij $$\left(\sum_j rij = 1\right),$$

and the number of waiting passengers on the *i*-th floor assigned to car A be *ni*. The forecast cage calls P*j* for the *j*-th floor for car A staying at the *k*-th floor is calculated, in the fashion of probability to be $$P_j = 1 - \prod_{i=k_j-1} (1 - rij)^{ni}.$$

In this connection, assume that the destination ratios of the waiting passengers are as shown in Table 1, that car A is staying at the 2nd floor for up travel and assigned with up hall calls from the 5th and 7th floors where 2 and 3 prospective passengers are waiting for car A respectively. The forecast 6th-floor up cage call for car A is $P_{6U} = 1 - (1 - 0.4)^2$, the forecast 7th-floor up cage call $P_{7U} - 1 - (1 - 0.2)^2$, the forecast 8th-floor up cage call $P_{8U} = 1 - (1 - 0.1)^2 \times (1 - 0.3)^2$, the forecast 9th-floor up cage call $P_{9U} = 1 - (1 - '0.2)^2 \times (1 - 0.5)^3$, the forecast 10th-floor down cage call $P_{10D} = 1 - (1 - 0.1)^2 \times (1 - 0.2)^3$ and the others 0. In other Table 1

| | Floors where passengers join the car | Destination floors: 1st floor | 2 floor | 3 floor | 4 floor | 5 floor | 6 floor | 7 floor | 8 floor | 9 floor | 10 floor |
|---|---|---|---|---|---|---|---|---|---|---|---|
| Up | 1st floor | | 0.1 | 0.2 | 0.1 | 0.1 | 0.1 | 0.1 | 0.1 | 0.1 | 0.1 |
| | 2 floor | | | 0.1 | 0.2 | 0.1 | 0.2 | 0.1 | 0.1 | 0.1 | 0.1 |
| | 3 floor | | | | 0.1 | 0.1 | 0.3 | 0.1 | 0.1 | 0.2 | 0.1 |
| | 4 floor | | | | | 0.1 | 0.3 | 0.2 | 0.1 | 0.2 | 0.1 |
| | 5 floor | | | | | | 0.4 | 0.2 | 0.1 | 0.2 | 0.1 |
| | 6 floor | | | | | | | 0.4 | 0.2 | 0.2 | 0.2 |
| | 7 floor | | | | | | | | 0.3 | 0.5 | 0.2 |
| | 8 floor | | | | | | | | | 0.6 | 0.4 |
| | 9 floor | | | | | | | | | | 1.0 |
| Down | 10th floor | 0.2 | 0.1 | 0.1 | 0.1 | 0.1 | 0.1 | 0.1 | 0.1 | | |
| | 9 floor | 0.2 | 0.1 | 0.1 | 0.1 | 0.1 | 0.2 | 0.1 | 0.1 | | |
| | 8 floor | 0.2 | 0.2 | 0.1 | 0.1 | 0.1 | 0.2 | 0.2 | | | |
| | 7 floor | 0.4 | 0.1 | 0.1 | 0.2 | 0.1 | 0.1 | | | | |
| | 6 floor | 0.3 | 0.1 | 0.2 | 0.2 | 0.2 | | | | | |
| | 5 floor | 0.4 | 0.2 | 0.2 | 0.2 | | | | | | |
| | 4 floor | 0.6 | 0.2 | 0.2 | | | | | | | |
| | 3 floor | 0.7 | 0.3 | | | | | | | | |
| | 2nd floor | 1.0 | | | | | | | | | |

(Note: Blank denotes 0.0)

words, the forecast cage call calculating device CPU, in response to outputs from the waiting-passenger-number detectors Hp1U, HP2U, . . . , HP2D, the encoder ENC and the distination-ratio setting device SET, calculates a forecast cage call $P_{j-1}$ for car A from the (j-1)th floor scanned by each clock pulse signal CP, according to the above-described formulae. To carry out this calculation, therefore, either a single-purpose processing system or a general-purpose electronic computer may be employed. The output FCC*a* of the forecast-cage call calculating device CPU is applied to the terminal 1 of the selector SEL on the one hand and to the circuit of FIG. 15 on the other. As will be seen from the foregoing description, by the way, the forecast cage call signal FCC*a*, unlike the corresponding signal in the preceding embodiment, is a signal proportional to the probability of generation of a call.

Signal generators SIG1 to SIG3 are provided for producing, for instance, signals of 1, 1.3 and 1.5 respectively, and connected respectively to the input terminals 2, 3 and 4 of the selector SEL which will be described later. The time required for a car to complete one service varies depending on the time required for replacement of passengers which in turn depends on whether the car has stopped in response to a cage call or a hall call or both. Such time differences are indicated by the signal generators SIG1 to SIG3, which represent the service time in response to a cage call, a hall call and both, repectively. In the above-illustrated example, it is assumed that the service time in response to a hall call is 1.3 times longer than that in response to a cage call, while the service time in response to both types of call is 1.5 times longer than that in response to a cage call.

The selector SEL is provided for the purpose of selecting and producing certain signals out of the output signals applied to the input terminals 1 to 4 from the forecast cage call calculating device CPU and the signal generators SIG1 to SIG3, in response to the select signals SH*a* and SC*a* from FIG. 9. The relation between input and output according to various states of select signals SC*a* and SH*a* shown in Table 2 below.

Table 2

| | | | | |
|---|---|---|---|---|
| Signal SCa | "0" | "1" | "0" | "1" |
| Signal SHa | "0" | "0" | "1" | "1" |
| Input terminal from which signal is produced at output terminal 0 | Terminal 1 | Terminal 2 | Terminal 3 | Terminal 4 |

If the *j*-th floor is scanned by the clock pulses, the selector SEL produces an output *Sj*, which is: $Sj = P_{j-1}$, namely, the output of the forecast cage call calculating device, when the signals SC*s* and SH*a* are "0", that is, when neither the *j*-th floor cage call is registered nor is any hall call assigned;

$Sj = 1.0$, namely, the output of the signal generator SIG1, when the signal SC*a* is "1" and SH*a* "0", that is, when only the 1st-floor cage call is registered; $Sj = 1.3$, namely, the output of the signal generator SIG2, when the signal SC*a* is "0" and SH*a* "1", that is, when only the *j*-th floor hall call is assigned; and $Sj = 1.5$, namely, the output of the signal generator SIG3, when both of the signals SH*a* and SC*a* are "1", that is, when the *j*-th floor cage call is registered and a hall call assigned.

The ouput of the selector SEL is added to the ouptut of the register REG inserted in a later stage, by the adder ADD1, the output of which is applied to and stored in the register REG again. The register REG is cleared to zero when the reset signal RS*a* from the circuit of FIG. 9 becomes "1", i.e., when the *j*-th floor scanned by the pulses CP coincides with the position of car A. As a result, the ouput R*j* from the register REG is the sum of the outputs from the selector SEL for the area from the position *k* of car A to the *j*-th floor scanned by the clock pulses CP and expressed as $$Rj = \sum_{i=k,j-1} Si.$$

In other words, a signal is obtained which represents a conversion of the time expected to be required for car A staying at the *k*-th floor to serve intermediate calls before arriving at the *j*-th floor, into the time required for car A to serve cage calls during the same period.

Figure 12:
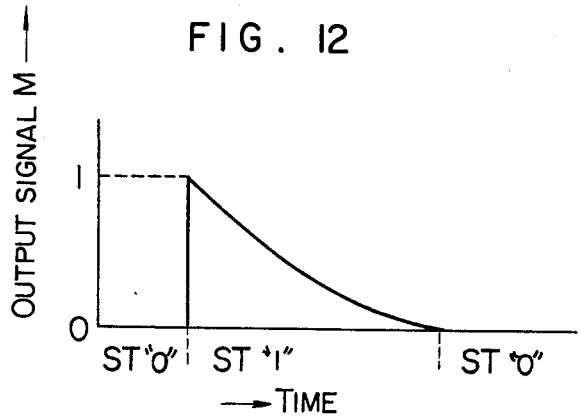
Figure 13:
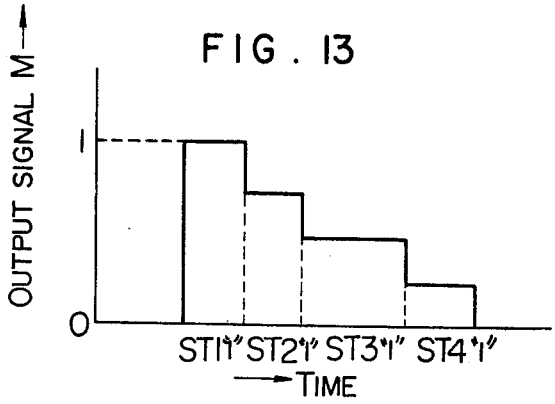

The signal generator MOD is for generating a signal M associated with a stationary state of car A. Generally, when a car begins to decelerate in response to a call, the hall call generated from and the cage call for the floor involved are cleared. In response to the generation of the "1" stop signal ST indicating the deceleration of car A, the signal generator MOD produces a progressively declining signal as shown in FIG. 12. As an alternative, the generator MOD may be adapted to produce, as shown in FIG. 13, a stop signal ST divided into a signal ST1 indicative of deceleration, a signal ST2 indicative of the door being opened, a signal ST3 indicating the door open, and a signal ST4 indicative of the door being closed, so that the signal generator MOD may produce a stepped signal according to the respective conditions.

The time converter TIM is a device for determining the time required for a car to cover a certain distance in response to the output from the counter CAU representing a floor interval and to the output of the signal generator MOD and the register REG associated with calls. The time required for a car to cover the interval of one floor is 1.4 seconds if the car speed is 150 m/minute and the height of each floor is 35 m. Also, the time required for a car to stop at and serve a floor depends on the car speed, door opening and closing time and time of passenger replacement. For example, it will be 7 seconds, if the time required for acceleration and deceleration is 3 seconds, the door opening and closing 2 seconds, and passenger replacement 2 seconds. In other words, the time converter TIM converts a one-floor portion of the output of the counter CAU into 1.4 seconds, and one cage call portion of the outputs of the register REG and the signal generator MOD into 7 seconds. The outputs of the time converter TIM are added to each other by the adder ADD2. Let the time conversion coefficients be *k*1 and *k*2 respectively for the above-mentioned two factors. In the event that the *j*-th floor is scanned by the clock pulses CP, the output T*j* of the adder ADD2 is expressed as $Tj = k1 \cdot Fj + k2 (Rj + M)$. This indicates the time required for car A to reach the *j*-th floor while serving any intermediate calls, i.e., the forecast waiting time.

The synchronizer ISC1 to which the output of the adder ADD2 is connected is a version of the scanners SCA1 to SCA3 in FIG. 9 with inputs and outputs thereof reversed, so that in response to each clock pulse signal, the signal applied to the input terminal O is produced at the terminals 1U, 2U, . . . , 9U, 10D, . . . 2D and again at 1U endlessly in that order. At the same time, the input signal is produced at the output terminal 1U when the floor scanned by the clock pulse signal CP is the 1st floor for up travel; and at the output terminal 2U when the floor scanned by the clock pulse signal CP is the 2nd floor for up travel. In this way, the synchronizer ISC1 operates in synchronism with the scanners SCA1 to SCA3. As a result, when the 1st floor for up travel is scanned by the clock pulse signal CP, the ouptut of the adder ADD2 is stored in the register R1 connected to the terminal 1U of the synchronizer ISC1. When the floor scanned is the 2nd floor for up travel, the output of the adder ADD2 is stored in the register R2U1 connected to the terminal 2U of the synchronizer ISC1. In like manner, when the scanned floor is the 2nd floor down, the output of the adder ADD2 is stored in the register R2D1 connected to the terminal 2D of the synchronizer ISC1. Therefore, the output signals W1U*a*, W2U*a*, . . . , W2D*a* of the registers R1U1, R2U1, . . . , R2D1 represent the forecast waiting time for the 1st-floor up travel, the 2nd-floor up travel, . . . , the 2nd-floor down travel of the car A, respectively.

Figure 14:
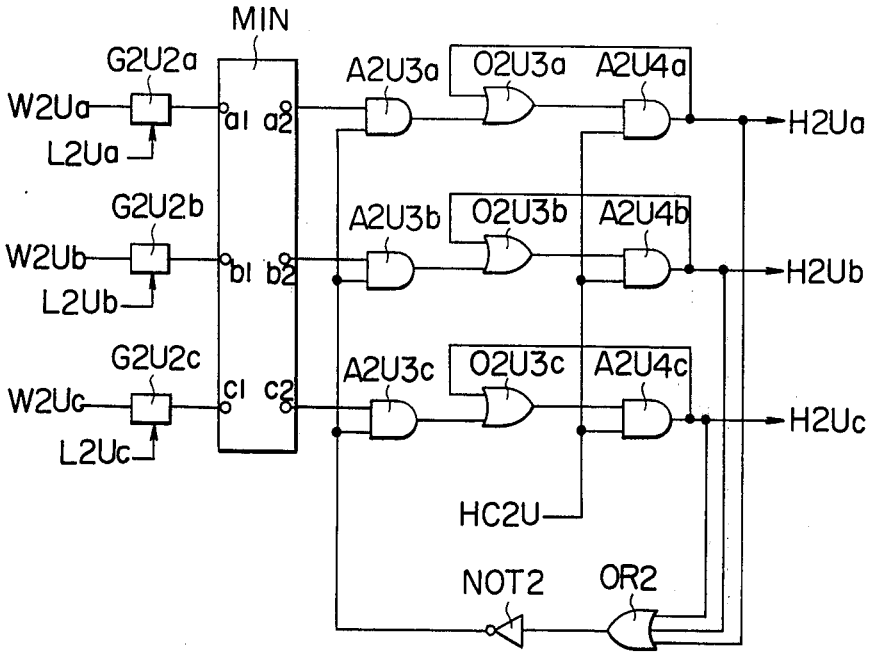

The diagram of FIG. 14 shows a circuit for assigning a hall call to a car in association with the 2nd floor, similar circuits being provided for the other floors. MIN shows a minimum selector for producing an output "1" in response to the smallest one of the inputs thereto, while producing "0" signals in response to the other input signals. The explanation of the operation below assumes that the forecast waiting time W2U*a* for car A is shorter than any of the forecast waiting time W2U*b* and W2U*c* for cars B and C for up travel, respectively. The output terminal *a*2 corresponding to the input terminal *a*1 impressed with the minimum signal is "1", whereas "0" signals are produced at the other terminals *b*2 and *c*2. (It is here assumed that the gate signals L2U*a*, L2U*b* and L2U*c* of the gate elements G2U2*a*, G2U2*b* and G2U2*c* which will be described later are all in the state of "1", and the signals W2U*a*, W2U*b* and W2U*c* are all applied to the minimum selector MIN.) The output signals of the minimum selector MIN are applied to the ND elements A2U3*a*, A2U3*b* and A2U3*c* together with the output of the NOT element NOT2. In the event that the signals H2U*a*, H2U*b* and H2U*c* are all in the state of "0", the output of the NOT element NOT2 is "1". A "1" signals is produced only from the AND element A2U3*a* connected to the output terminal *a*2 of the minimum selector MIN in the state of "1", while the other AND elements A2U3*b* and A2U3*c* produce "0" signals. The outputs of these three AND elements are applied to OR elements O2U3*a*, O2U3*b* and O2U3*c*. In view of the fact that the signals H2U*a*, H2U*b* and H2U*c* are all "0", only the OR element O2U3*a* one of the inputs to which is "1" produces a "1" output, while the outputs produced by the other OR elements O2U3*b* and O2U3*c* are in the state of "0". The outputs of these OR elements are applied to the AND elements A2U4*a*, A2U4*b* and A2U4*c* respectively. When a hall call is registered with the hall call register provided on the 2nd floor for up travel and the signal HC2U changes to "1", only the AND element A2U4*a* the two input signals to which are both "1" produces a "1" signal, while "0" signals are produced from the other AND elements A2U4*b* and A2U4*c*. When the output of the AND element A2U4*a* becomes "1", the output of the OR element O2U3*a* is held at "1" state irrespective of the output of the AND element A2U3*a* as the output "1" of the element A2U4*a* is applied to the OR element O2U3*a*. As a result, the output signal H2U*a* of the AND element A2U4*a* is held at "1" until the signal HC2U is reset to "0" after the 2nd-floor up hall call has been served. The "1" state of the ouput of the AND element A2U4*a* causes the OR element OR2 to produce a "1" signal, the NOT element NOT2 to produce a "0" output, and the AND elements A2U3*a*, A2U3*b* and A2U3*c* to be interlocked to produce "0" outputs regardless of the output of the minimum selector MIN. The assignment signals H2U*a*, H2U*b* and H2U*c* of cars A, B and C for the 2-nd-floor up hall call are "1", "0" and "0" respectively, so that the 2nd-floor up hall call is assigned to car A involving the shortest forecast waiting time. The signals H2U*a*, H2U*b* and H2U*c* are applied not only to the circuits of FIGS. 9 and 11, but to a guide indication circuit for indicating a service car on each hall and also to a control circuit (not shown) for stopping the car at the floor generating the hall call assigned to the car.

Figure 15:
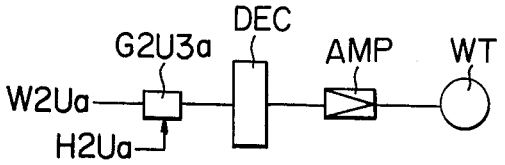

An example of the circuit for indicating a forecast waiting time is shown in FIG. 15. In the event that the 2nd-floor up hall call is assigned to car A and the assignment signal H2U*a* becomes "1", a forecast waiting time is indicated on the indication device WT through the gate element G2U3*a*, decoder DEC and amplifier AMP, the indication device WT being mounted on the 2nd floor hall. Instead of providing the indication device for each elevator car as shown in FIG. 15, an indication device common to all the elevator cars may be employed. Also, a forecast waiting time may be indicated all the time instead of only when a hall call is assigned as in the case of FIG. 15. Further, the indication method may take another alternative form including digital indication, analog indication or acoustic annunciation. Furthermore, these devices may be located either on a specific floor or floors or in the caretaker's room.

Figure 16:
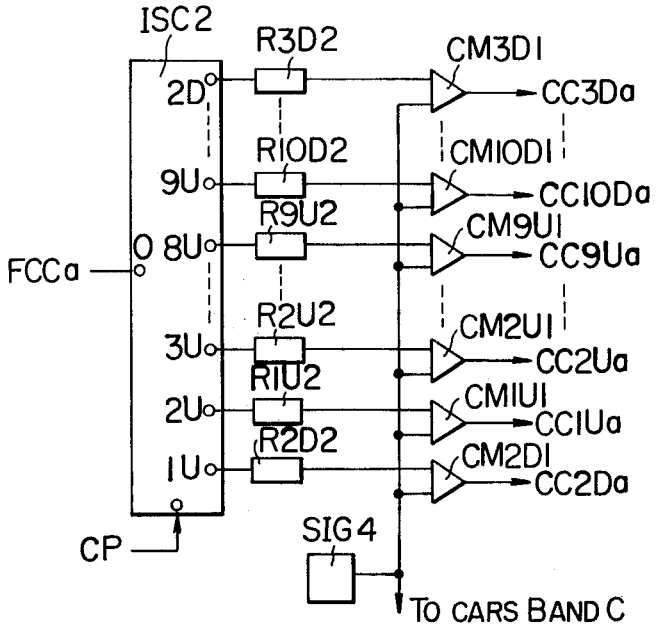
Figure 17:
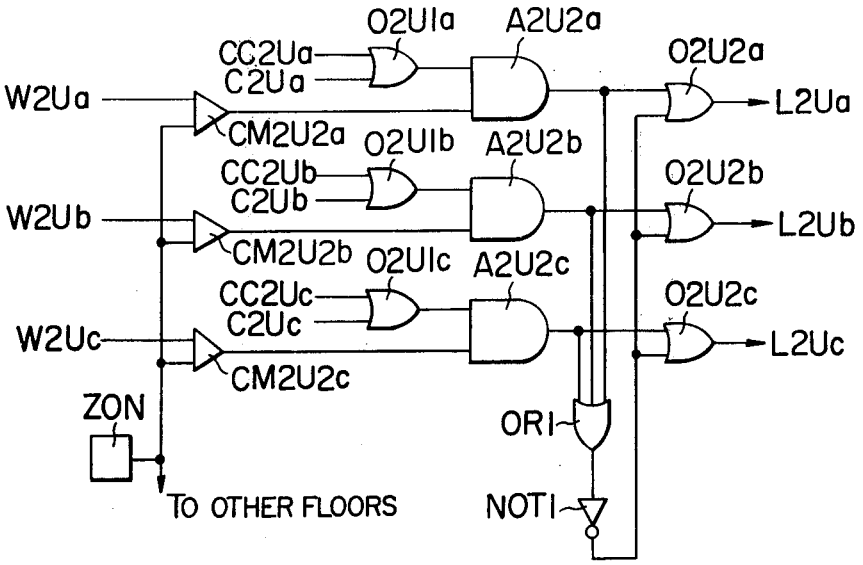

The diagrams of FIGS. 16 and 17 show interlock circuits for assigning a hall call to a car in which the hall call coincides with a cage call, in priority over the other cars. The circuit of FIG. 16 is for car A, and similar circuits are provided for cars B and C respectively. The circuit of FIG. 17 is associated with the 2nd-floor for up travel, and similar circuits are provided for the other circuits respectively.

In FIG. 16, the synchronizer ISC2 produces, like the synchronizer ISC1 in FIG. 11, the input signal thereto at the output terminals 1U, 2U, . . . , 2D thereof in that order in synchronism with the scanners SCA1 to SCA3 in response to each clock pulse signal CP. If the 1st-floor for up travel is scanned by the clock pulse signal CP, for instance, the signal FCC*a* in FIG. 3 indicating a 2nd-floor down forecast cage call is applied to and stored in the register R2D2. When the scanning of the clock pulse signal CP changes to the 2nd-floor for up travel, the signal FCC*a* in FIG. 3 indicating a 1st-floor up forecast cage call is applied to the register R1U2. In like manner, the forecast cage call signals for the 2nd-floor for up travel, 3rd-floor for up travel, . . . , 3rd-floor for down travel are stored in the registers R2U2, R3U2, . . . , R3D2 respectively. The outputs of the registers R2D2, R1U2, . . . , R3D2 are compared with the ouput of the signal generator SIG4 in the comparators CM2D1, CM1U1, . . . , CM3D1 respectively; so that "1" and "0" signals are produced from the comparators when the output signal from the signal generator SIG4 is larger and smaller than the respective signals. The signal from the signal generator SIG4 is for selecting, for the purpose of lockout and as second forecast call signals, those forecast cage calls with the probability of generation higher than a predetermined value and most likely to be registered. Thus the signal generator SIG4 produces a signal representing the probability of generation of 0.8 as an example. The output signals CC1U*a*, CC2U*a*, . . . , CC2D*a* of the comparators CM1U1, CM2U1, . . . , CM2D1 respectively are applied to the circuit of FIG. 17 as the second forecast cage call signals for the 1st-floor for up travel, the 2nd-floor for up travel, . . . , the 2nd-floor for down travel respectively.

In FIG. 17, the cage call signals C2U*a*, C2U*b* and C2U*c* for the 2nd-floor up travel of the respective cars are applied to the OR elements O2U1*a*, O2U1*b* and O2U1*c* together with the second forecast cage call signals CC2U*a*, CC2U*b* and CC2U*c* respectively. The outputs of the OR elements O2U1*a*, O2U1*b* and O2U1*c* are connected to the AND elements A2U2*a*, A2U2*b* and A2U2*c* respectively. The forecast waiting time W2U*a*, W2U*b* and W2U*c* for 2nd-floor up travel of the respective cars are compared with the outputs of the signal generator ZON generating a predetermined time signal, in the comparators CM2U2*a*, CM2U2*b* and CM2U2*c* respectively, which produce "1" signals when the waiting time signals W2U*a*, W2U*b* and W2U*c* are smaller then the output of the signal generator ZON respectively. The outputs of the comparators CM2U2*a*, CM2U2*b* and CM2U2*c* are applied to the AND elements A2U2*a*, A2U2*b* and A2U2*c* as each of the inputs thereto. By the way, an unlimited lockout of the coincidence between a cage call and a hall call may result in a very far elevator car being assigned with the hall call inconveniently, thus causing an undesirable call involving a long waiting time. The signal generator ZON is provided for the purpose of limiting the lockout operation within a predetermined range to obviate such an inconvenience.

As a result, the AND element A2U2*a*, A2U2*b* or A2U2*c* for car A, B or C respectively produces a "1" signal when the forecast waiting time signal W2U*a*, W2U*b* or W2U*c* for the 2nd-floor up travel is smaller than the output of the signal generator ZON and when the 2nd-floor up cage call C2U*a*, C2U*b* or C2U*c* is registered as a "1" signal or the second forecast cage call signal CC2U*a*, CC2U*b* or CC2U*c* is in the state of "1", respectively.

In the event of that the above-mentioned conditions are not met by any of cars A, B and C and that the AND elements A2U2*a*, A2U2*b* and A2U2*c* all produce "0" signals, then the OR element OR1 produces a "0" signal and the NOT element NOT1 a "1" signal. The output signals L2U*a*, L2U*b* and L2U*c* of the OR elements O2U2*a*, O2U2*b* and O2U2*c* are all in the state of "1". The gate elements G2U2*a*, G2U2*b* and G2U2*c* in FIG. 14 are all opened thereby to transmit all the forecast waiting time signals W2U*a*, W2U*b* and W2U*c* for the 2nd-floor up travel of cars A, B and C respectively to the minimum selector MIN for hall call assignment as mentioned before.

Suppose only car A satisfies the above-mentioned conditions with the result that the output of the AND element A1U2*a* is "1" while the AND elements A2U2*b* and A2U2*c* for the other cars B and C produce "0" signals. The outputs of the OR element OR1 and the NOT element NOT1 are "1" and "0" respectively. Only the OR element 02U2*a* one of the input signals to which is "1" produces the output signal L2U*a* in the state of "1", while the output signals L2U*b* and L2U*c* of the other OR elements 02U2*b* and 02U2*c* are "0". Consequently, only the gate element G2U2*a* in FIG. 14 opens, so that the forecast waiting time signal W2U*a* for the 2nd-floor up travel of car A is applied to the minimum selector MIN, while the forecast waiting time signals W2U*b* and W2U*c* for the 2nd-floor up travel of the other cars B and C are prevented from being applied to the minimum selector MIN. In other words, cars B and C are excluded from the assignment of a hall call as described in FIG. 14. Thus the hall call generated from the floor associated with the cage call (the cage call actually registered and the second forecast cage call) is assigned to a particular elevator car and locked out in priority over the other cars.

The foregoing description concerns an embodiment of the invention applied to the control system assigning hall calls to elevator cars. This embodiment enables the forecast waiting time for each floor to be processed taking into consideration cage calls expected to be generated by serving hall waiting passengers, thus making possible a highly accurate calculation of the forecast waiting time. Also, by employing the forecast waiting time thus calculated, as a condition for hall call assignment, hall calls are assigned most properly, thereby further improving the elevator car operating efficiency. In addition, the hall waiting time is made uniform and shortened. For example, an assigned hall call involving a long waiting time, one of the shortcomings of the conventional system, is eliminated which may arise from the serving of intermediate floors required by cage calls newly registered by many new passengers before reaching the assigned hall call, thus leading to an improved services to the hall waiting passengers.

In place of the above-mentioned method in which cage calls are forecast directly from the number of the hall waiting passengers, the method mentioned below may be employed for forecasting such a number.

The relation between the waiting passenger number *ni* associated with the *i*-th floor and the ratio *qi*(*ni*) of a cage call which may be generated by the serving of the *i*-th floor hall call is tabulated in advance. The forecast cage call P*j* for the *j*-th floor for car A staying at the *K*-th floor is calculated by $$P_j = \sum_{i = kj - 1} q - 1(n - 1) \times rij.$$

Incidentally, the ratio of *qi*(*ni*) of cage call generation by the waiting prospective passengers should be properly determined in a similar way to the destination ratio rij in accordance with the character of each building and the past history of passengers. Even in the same building, the cage call generation ratio *qi*(*ni*) is subject to adjustment by the signal PT in conformity with the prevailing traffic demand, in view of the fact that many hall calls from the lobby floor are generated during morning rush hours, while most of the calls generated during evening rush hours are cage calls for the lobby floor.

Table 3 shows an example of the ratios *qi*(*ni*) of cage call generation by the hall waiting passengers joining a car, as set in the cage-call-generation-ratio-setting device SET2 in FIG, 18. For example, if the number of waiting passengers proves to be zero when the 6th-floor up hall call is served, the number of cage calls is zero; if the number of waiting passengers is 1 to 2, the number of cage calls is 1; if 3 to 4 persons are waiting, the number of cage calls is 2; if 5 to 6 persons are waiting, cage calls are 3; and for the waiting passengers 7 or more, 4 cage calls are expected to be generated. The forecast cage call calculating device CPU is connected not only to the input thereto mentioned with reference to the foregoing embodiment but to the cage-call-generation-ratio-setting device SET2 thereby to conduct a processing operation according to the formula described above. In this case, forecast cage calls are calculated in accordance with the number of cage calls generated. In the embodiment of FIG. 11, cage calls are forecast in accordance with the number of hall waiting passengers. In other words, the probability of cage call generation for each floor and cage calls themselves increase in exact proportion to the number of hall waiting Table 3

| Floors where passengers join the car | | Number of hall waiting prospective passengers | | | | | | | | | | | | |
|---|---|---|---|---|---|---|---|---|---|---|---|---|---|---|
| | | 0 | 1 | 2 | 3 | 4 | 5 | 6 | 7 | 8 | 9 | 10 | 11 | ... |
| Up | 1st floor | 0 | 1 | 2 | 3 | 3 | 4 | 4 | 4 | 5 | 5 | 5 | 6 | ... |
| | 2nd floor | 0 | 1 | 1 | 2 | 2 | 3 | 3 | 4 | 4 | 5 | 5 | 6 | ... |
| | 3rd floor | 0 | 1 | 1 | 1 | 2 | 3 | 3 | 3 | 4 | 4 | 4 | 5 | ... |
| | 4th floor | 0 | 1 | 1 | 2 | 2 | 3 | 3 | 3 | 4 | 5 | 5 | 5 | ... |
| | 5th floor | 0 | 1 | 2 | 2 | 3 | 3 | 3 | 3 | 4 | 4 | 5 | 5 | 5 |
| | 6th floor | 0 | 1 | 1 | 2 | 2 | 3 | 3 | 4 | 4 | 4 | 4 | 4 | 4 |
| | 7th floor | 0 | 1 | 2 | 2 | 2 | 3 | 3 | 3 | 3 | 3 | 3 | 3 | 3 |
| | 8th floor | 0 | 1 | 1 | 2 | 2 | 2 | 2 | 2 | 2 | 2 | 2 | 2 | 2 |
| | 9th floor | 0 | 1 | 1 | 1 | 1 | 1 | 1 | 1 | 1 | 1 | 1 | 1 | 1 |
| Down | 10th floor | 0 | 1 | 1 | 2 | 2 | 2 | 2 | 3 | 3 | 4 | 4 | 4 | ... |
| | 9th floor | 0 | 1 | 1 | 2 | 2 | 3 | 3 | 3 | 4 | 4 | 5 | 5 | ... |
| | 8th floor | 0 | 1 | 2 | 3 | 3 | 3 | 4 | 4 | 4 | 5 | 6 | 6 | ... |
| | 7th floor | 0 | 1 | 2 | 2 | 2 | 3 | 3 | 4 | 4 | 5 | 5 | 6 | 6 |
| | 6th floor | 0 | 1 | 1 | 2 | 2 | 2 | 3 | 3 | 4 | 5 | 5 | 5 | 5 |
| | 5th floor | 0 | 1 | 1 | 2 | 2 | 3 | 3 | 3 | 4 | 4 | 4 | 4 | 4 |
| | 4th floor | 0 | 1 | 2 | 2 | 2 | 2 | 2 | 3 | 3 | 3 | 3 | 3 | 3 |
| | 3rd floor | 0 | 1 | 1 | 1 | 2 | 2 | 2 | 2 | 2 | 2 | 2 | 2 | 2 |
| | 2nd floor | 0 | 1 | 1 | 1 | 1 | 1 | 1 | 1 | 1 | 1 | 1 | 1 | 1 |

passengers. With the increase in hall waiting passengers, however, more persons are likely to proceed for the same floor or floors, and therefore cage calls may not increase in proportion to the hall waiting passengers. In view of this, the embodiment under consideration is such that cage calls are forecast on the basis of the number of cage calls generated.

The destination-ratio-setting device SET in the embodiment of FIG. 11 was explained with reference to the case as shown in Table 1. The destination-ratio-setting device referred to by this invention, however, also includes those means whereby cage calls generated are set and tabulated in advance for various numbers of hall waiting passengers. For example, let us consider the case of 5 persons waiting at the 1st floor and corresponding 4 cage calls generated as forecast in Table 3. The destination-ratio-setting device may alternatively be operated on the basis of a tabulated list of cage calls which is so set that, when there are 5 prospective passengers waiting at the 1st floor, for example, cage calls are generated for the 3rd, 5th and 7th floors. In this case, the destination-ratio-setting device is very complicated and high in cost as compared with the embodiment of FIG. 11. In spite of this, this alternative is applicable to those buildings where there is a fixed relation between the number of hall waiting passengers and destination floors or to specific floors.

Even though the forecast cage call calculating device CPU in the embodiment of FIG. 11 produces the probability of cage call generation to the selector SEL as forecast cage calls, the device CPU may be so constructed as to produce "1" signals in response to the probability of cage call generation more than a predetermined value of, say, 0.8 and "0" signals in response to a lower probability.

Further, the foregoing description is with reference to a control system for assigning registered hall calls to cars. The means for calculating forecast cage calls generated by hall waiting passengers according to the invention, however, may apparently be applied to the other types of control system in a corresponding degree of effectiveness. In any case, a highly reliable elevator control is achieved taking into consideration cage calls generated by the hall waiting passengers joining cars. In order to further improve the control efficiency, it is also effective to readjust the destination ratio or cage call generation ratio in accordance with the prevailing traffic demand from time to time.

What we claim is:

1. In an elevator system comprising cage call register means, hall call register means and a plurality of elevator cars in juxtaposition serving a plurality of floors in response to said cage call register means and said hall call registers means; an elevator control apparatus comprising means for detecting the number of waiting-prospective passengers on each floor hall, means for setting the ratios of said hall-waiting-prospective passengers proceeding to respective floors, and means for forecasting and calculating cage calls on the basis of said number of hall-waiting-prospective passengers detected by said detector means and said destination ratios set by said setting means, said cage calls being registered by said hall waiting-prospective passengers joining a car.

2. An elevator control apparatus according to claim 1, in which said cage-call-forecasting-and-calculating means include means for calculating the number of hall-waiting-prospective passengers by destination on the basis of said number of hall-waiting-prospective passengers and said destination ratios.

3. An elevator control apparatus according to claim 1, in which said cage-call-forecasting-and-calculating means include means for calculating the number of hall-waiting-prospective passengers and said destination ratios, and means for selecting destination floors for each of which said number of hall-waiting-prosepective passengers by destination is more than a predetermined ratio of said hall-waiting-prospective passengers, said selected destination floors being calculated in the form of forecast cage calls.

4. An elevator control apparatus according to claim 3, further comprising means for producing said number of hall-waiting-prospective passengers by destination for each of said selected floors, and means for correcting said number of hall-waiting-prospective passengers by destination in such a manner that the total number of hall-waiting-prospective passengers by destination of all of said selected floors coincides with said number of hall-waiting-prospective passengers.

5. An elevator control apparatus according to claim 1, further comprising means for adjusting said destination ratios in accordance with traffic demand.

6. An elevator control apparatus according to claim 1, further comprising means for adjusting said destination ratios in accordance with said number of hall-waiting-prospective passengers.

7. An elevator control apparatus according to claim 1, further comprising means for setting a ratio of cage call generation and means for calculating the number of cage calls generated, on the basis of said ratio of cage call generation and said number of hall-waiting-prospective passengers, said cage-call-forecasting-and-calculating means forecasting and calculating cage calls on the basis of said number of cage calls and said destination ratios.

8. An elevator control apparatus according to claim 1, further comprising means for assigning generated hall calls to cars, and means for forecasting and calculating cage calls for each car in response to said destination ratio for each car and the number of hall-waiting-prospective passengers at the floor to which said hall call is assigned.

9. An elevator control apparatus according to claim 8, further comprising means for calculating the forecast waiting time required for each car to arrive each floor, said means being impressed with at least a signal representing the position of said car and cage calls, said forecast-waiting-time- calculating means being impressed with forecast cage calls for the floor generating said assigned hall call, said forecast-waiting-time-calculating means producing a forecast waiting time taking into account the time required to serve said forecast cage calls.

10. An elevator control apparatus according to claim 9, further comprising means for selecting, for each floor, a car shoter then the other cars in said forecast waiting time in priority over said other cars, said hall call assigning means including means for assigning a hall call to said selected car.

11. An elevator control apparatus according to claim 8, further comprising, for each car, means for detecting a coincidence between a cage call and a forecast cage call and a hall call, said hall call assigning means including means for assigning a hall call to a car having a cage call coinciding with said hall call, in priority over the other cars.

12. An elevator control apparatus according to claim 11, further comprising means for calculating a forecast waiting time and means for detecting a car involving said forecast waiting time below a predetermined value, said hall call assigning means including means for assigning a hall call to a car having a cage call coinciding with said hall call, in priority over the other cars, said car involving said forecast waiting time below said predetermined value.

13. An elevator control apparatus according to claim 9, further comprising means for indicating said calculated forecast waiting time on each elevator hall.

14. An elevator control apparatus according to claim 13, further comprising means for indicating, on the floor generating said hall call, said forecast waiting time for said car to which said hall call is assigned.

* * * * *